US007780252B2

(12) United States Patent
Mushan et al.

(10) Patent No.: US 7,780,252 B2
(45) Date of Patent: Aug. 24, 2010

(54) ELONGATED STAGING LOCK FOR A DRAWER SLIDE

(75) Inventors: Huang Mushan, Singapore (SG); Wenming Yang, Singapore (SG); Meng Kee Koh, Singapore (SG); Alfred E. Barry, Jr., Atlanta, GA (US)

(73) Assignee: Central Industrial Supply Company, Tucson, AZ (US)

( * ) Notice: Subject to any disclaimer, the term of this patent is extended or adjusted under 35 U.S.C. 154(b) by 616 days.

(21) Appl. No.: 11/707,754

(22) Filed: Feb. 16, 2007

(65) Prior Publication Data

US 2008/0197758 A1 Aug. 21, 2008

(51) Int. Cl.
*A47B 88/00* (2006.01)

(52) U.S. Cl. ..... 312/333; 312/334.47

(58) Field of Classification Search ..... 312/333, 312/334.44–334.47, 319.1, 334.7, 334.8, 312/334.41; 384/21, 22; 403/13, 14
See application file for complete search history.

(56) References Cited

U.S. PATENT DOCUMENTS

| | | | | |
|---|---|---|---|---|
| 534,434 | A | 2/1895 | Frost | |
| 1,557,765 | A | 10/1920 | Nicholas | |
| 2,862,772 | A | 12/1958 | Gussack | |
| 4,272,139 | A | 6/1981 | Fler | |
| 4,423,914 | A * | 1/1984 | Vander Ley | 312/333 |
| 4,441,772 | A | 4/1984 | Fielding et al. | |
| 4,560,212 | A | 12/1985 | Papp et al. | |
| 4,610,487 | A * | 9/1986 | Delmege et al. | 384/18 |
| 4,662,761 | A | 5/1987 | Hoffman | |
| 4,696,582 | A | 9/1987 | Kasten | |
| 4,923,259 | A * | 5/1990 | Bartok | 312/223.2 |
| 5,433,517 | A | 7/1995 | Fleisch | |
| 5,551,775 | A | 9/1996 | Parvin | |
| 5,757,109 | A | 5/1998 | Parvin | |
| 5,851,059 | A | 12/1998 | Cirocco | |
| 5,871,265 | A | 2/1999 | Stewart et al. | |
| 5,961,193 | A | 10/1999 | Hobbs | |
| 6,062,645 | A * | 5/2000 | Russell | 297/410 |
| 6,350,001 | B1 * | 2/2002 | Chu | 312/334.44 |
| 6,367,899 | B1 * | 4/2002 | Hwang et al. | 312/334.47 |
| 6,402,275 | B1 * | 6/2002 | Yang | 312/334.46 |
| 6,412,891 | B1 * | 7/2002 | Liang et al. | 312/334.44 |
| 6,464,311 | B2 | 10/2002 | Liang et al. | |
| 6,685,288 | B1 | 2/2004 | MacMillan | |
| 6,705,689 | B2 | 3/2004 | Chen et al. | |
| 6,805,418 | B2 | 10/2004 | Milligan | |

(Continued)

*Primary Examiner*—Darnell M Jayne
*Assistant Examiner*—Andres Gallego
(74) *Attorney, Agent, or Firm*—Mark W Handley

(57) ABSTRACT

A staging lock (22) is movably mounted to an intermediate member (16), and has a follower tab (58) and a lock tab (66). When the intermediate member (16) is fully extended from within the cabinet member (14), the follower tab (58) engages a cam form (106) on the cabinet member (14) and moves the staging lock (22) from a closed position to an open position. When the staging lock (22) is disposed in the closed position, the lock tab (66) engages a staging lock catch (114) on the chassis member (18) to secure the chassis member (18) in a fully retracted position within the intermediate member (16). When the staging lock (22) is moved to the open position, the chassis member (18) may extend from within the intermediate member (16). A rear lock (24) retains the intermediate member (16) in a fully extended position until the chassis member (18) is fully retracted within the intermediate member (16).

19 Claims, 3 Drawing Sheets

U.S. PATENT DOCUMENTS 6,851,773 B2 * 2/2005 Chen et al. ..... 312/334.46
6,851,774 B2 * 2/2005 Chen et al. ..... 312/334.47
6,860,575 B2 * 3/2005 Chen et al. ..... 312/334.46
6,945,619 B1 * 9/2005 Chen et al. ..... 312/334.47
6,979,067 B2 * 12/2005 Yang ..... 312/334.46
6,984,008 B2 * 1/2006 Milligan ..... 312/333
7,029,080 B2 * 4/2006 Barry et al. ..... 312/333
7,101,081 B2 * 9/2006 Chen et al. ..... 384/21
7,374,261 B1 * 5/2008 Wang ..... 312/333
7,404,611 B1 * 7/2008 Que ..... 312/334.46
2004/0174100 A1 * 9/2004 Chen et al. ..... 312/333
2004/0244147 A1 * 12/2004 Qin et al. ..... 16/330
2006/0279187 A1 * 12/2006 Yang et al. ..... 312/333
2007/0164645 A1 * 7/2007 Chen et al. ..... 312/334.47
2008/0150409 A1 * 6/2008 Huang et al. ..... 312/334.46
2009/0001864 A1 * 1/2009 Huang et al. ..... 312/333

* cited by examiner 12
14
16
18
20
22
24
26
28
30
34
36
38
40
42
44
46
48
50
52
54
56
58
60
62
66
68
70
72
76
78
80
82
84
86
94
96
98

ELONGATED STAGING LOCK FOR A DRAWER SLIDE

TECHNICAL FIELD OF THE INVENTION

The present invention relates in general to drawer slides, and in particular to a staging lock for a sequencing extension and retraction of drawer slide members.

BACKGROUND OF THE INVENTION

Drawer slides have been provided for supporting chassis, or drawers, in a cantilevered arrangement, such that the chassis may be inserted into and removed from within a cabinet or a rack while supported by respective drawer slides. Drawer slides usually have two or three slide members, with a first slide member mounted to a cabinet, or rack, and a second slide member mounted to the chassis. Three part drawer slides have three slide members: a cabinet member which is mounted in fixed relation to a cabinet or rack, an intermediate member which is slidably mounted to the cabinet member for telescopically extending from and retracting into the cabinet member, and a chassis member which is slidably mounted to the intermediate member for telescopically extending from and retracting into the intermediate member. An equipment chassis, or drawer, is mounted to the chassis member. Bearings spaced apart by bearing retainers have been provided between mating drawer slide members. Some drawer slides have frictional sliding engagement between mating drawer slide members, rather than bearings.

Drawer slide locks have been provided for selectively latching drawer slide members in selected relative positions. Staging locks have been used with three part drawer slides to selectively determine the sequence of whether the intermediate member or the chassis member is the first to extend from within a cabinet member, and whether the intermediate member or the chassis member is the first to move from an extended position into the cabinet member or the intermediate member, respectively. Staging locks have been mounted to intermediate members and engage cam forms on the cabinet members to move between open positions, or unlatched positions, and closed positions, or latched positions. Lock catches have been provided on the chassis members for the staging locks to engage when disposed in the closed positions, or locked positions, when respective chassis members, intermediate members and cabinet members are disposed in selected relative relations. The lock catches have been provided by forms stamped into web portions of cabinet members. For some applications, it is desirable that the chassis member fully extend from within the intermediate member prior to extension of the intermediate member from the cabinet member, and that the chassis member fully retract into the intermediate member prior to the intermediate member retracting into the cabinet member.

SUMMARY OF THE INVENTION

A staging lock is provided for a three part drawer slide for selectively determining the sequence at which the chassis member and the intermediate member will extend from a cabinet member. The staging lock is pivotally mounted to the intermediate member, and has and actuation portion which includes a follower tab and a lock tab. The follower tab engages a cam form embossed on the cabinet member to disposed the staging lock in an open position, or unlocked position. The lock tab engages a staging lock catch formed into the chassis member. When disposed in the closed position, or locked position, the lock tab will engage the staging lock catch to secure the chassis member in fixed relative relation to the intermediate member. Preferably, the staging lock, the cam form and the staging lock catch are disposed in relative positions for retaining the chassis member in fixed relation to the intermediate member until the intermediate member is fully extended from within the cabinet member. Upon full extension of the intermediate member, the follower tab of the staging lock will engage the cam form of the cabinet member, moving the staging lock to the open position and releasing the lock tab from engaging the staging lock catch. The chassis member may then extend from within the intermediate member. A rear lock is preferably provided for securing the intermediate member in an extended position until the chassis member is fully retracted within the intermediate member, and the staging lock is moved from engaging the cam form and engages the staging lock catch to secure in the chassis member in fixed relation relative to the intermediate member.

DESCRIPTION OF THE DRAWINGS

For a more complete understanding of the present invention and the advantages thereof, reference is now made to the following description taken in conjunction with the accompanying Drawings in which

FIG. 1 is a partially exploded, perspective view of a drawer slide having a staging lock according to the present invention;

FIG. 2 is a perspective view of an inward side of the staging lock;

FIG. 3 is an exploded view of the rearward side of the staging lock;

FIG. 4 is a partial perspective view of an inward side of a cabinet member, and shows an actuating cam for the staging lock and a catch for the rear lock;

FIG. 5 is a partial, exploded view of the drawer slide, showing a portion of the chassis member, the staging lock, and the intermediate member;

FIG. 6 is a partial, exploded view of a portion of the drawer slide, showing the staging lock catch and the staging lock engaging the actuating cam with the staging lock shown in a locked position; and FIG. 7 is a partial, exploded view of the drawer slide, showing a portion of the chassis member having the staging lock catch, and the staging lock in an open position mounted to the intermediate member.

DETAILED DESCRIPTION OF THE INVENTION

Figures 1, 2, 3:
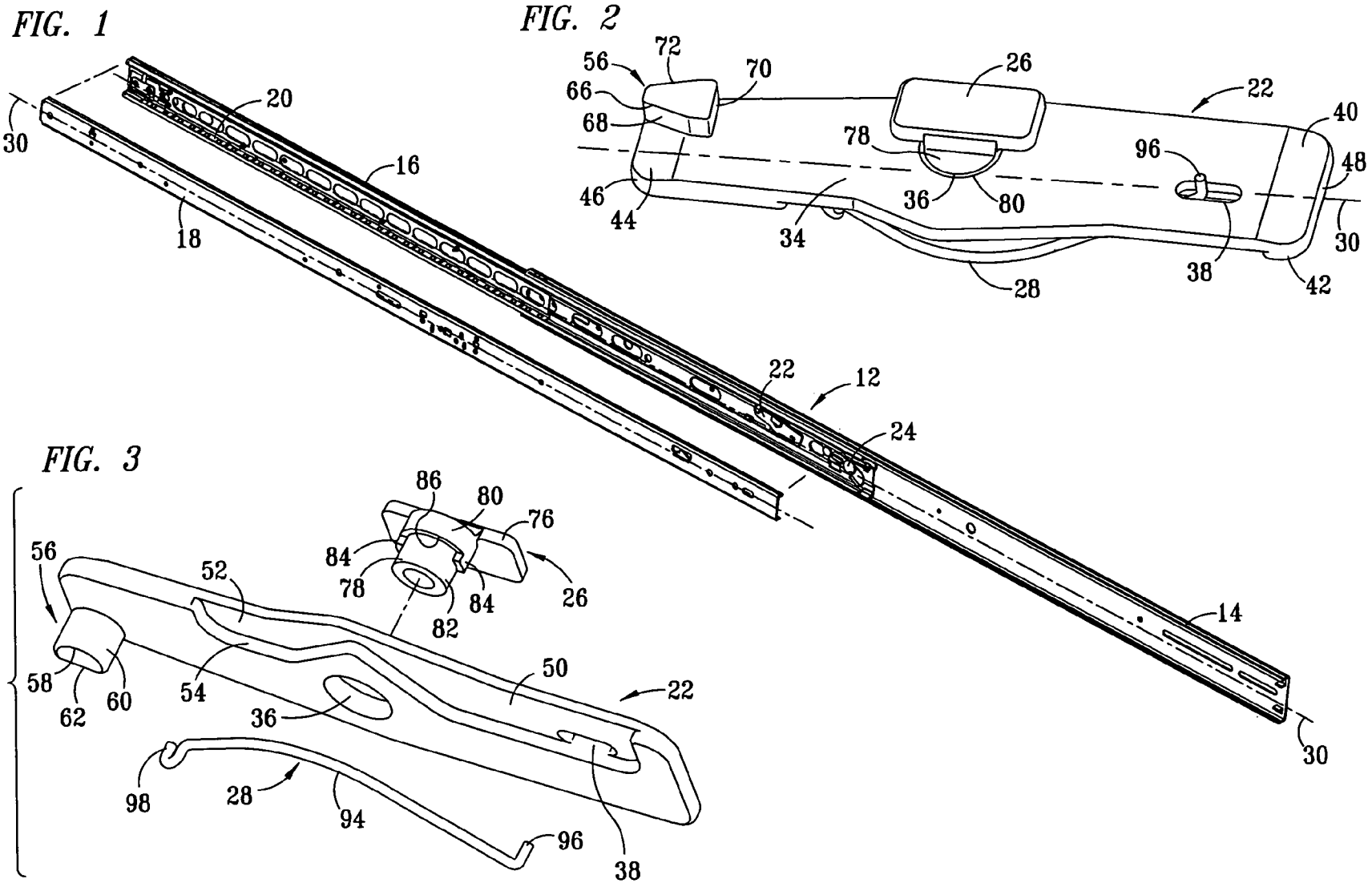
FIGS. 1 through 7 show various aspects for an elongated staging lock for a drawer slide device made according to the present invention, as set forth below.

FIG. 1 is a perspective view of a drawer slide 12 shown in a partially extended position. The drawer slide 12 has a cabinet member 14, an intermediate member 16, and a chassis member 18. The cabinet member 14 defines an outward slide member, or first slide member, the chassis member 18 defines an inward slide member, or a third slide member, and the intermediate member 16 defines a second slide member disposed between the cabinet member 14 and the chassis member 18. A bearing retainer 20 is preferably provided for retaining ball bearings in space apart relation disposed between the intermediate member 16 and the chassis member 18. A ball bearing assembly (not shown) is also preferably provided between the cabinet member 14 and the intermediate member 16. The cabinet member 14, the intermediate member 16, and the chassis member 18 are slide members which preferably have U-shaped cross sections with web portions and flange portions. The web portions of the slide members 14, 16 and 18 are vertically mounted within cabinets, or racks, with the flange portions extending horizontally for engaging flange portions of mating slide members in a sliding engagement. The chassis member 18 is slidably extensible from within the intermediate member 16, and the intermediate member 16 is slidably extensible from within the cabinet member 14 along a longitudinal axis 30 of the drawer slide 12. The intermediate member 16 is shown disposed in a position fully extended from within the cabinet member 14. The chassis member 18 is shown in a retracted position relative to the intermediate member 16 and the cabinet member 14, spaced apart from the side of the intermediate member 16. The drawer slide 12 includes a staging lock 22 and a rear lock 24 which determine the sequence in which the chassis member 18 and the intermediate member 16 extend and retract from within the cabinet member 14. Preferably, the chassis member 18 will extend from the intermediate member 16 after the intermediate member 16 has fully extended from within the cabinet member 14, and then the chassis member 18 will fully retract into the intermediate member 16 prior to the intermediate member 16 retracting into the cabinet member 14.

FIG. 2 is a perspective view of the staging lock 22, a rivet 26, and a bias spring 28 mounted to the staging lock 22, as viewed from an inward side, or chassis side, of the staging lock 22. The staging lock 22 has an elongated body 32 having a central portion 34 in which a mounting hole 36 is centrally disposed. As used herein, the term elongated refers to a member having a length which is significantly greater than the width of the member. Preferably, the elongated body has a length which is five to six times greater than the width. The mounting hole 36 is provided for receiving the rivet 26, which provides a mounting boss. A spring hole 38 is formed in the central portion 34, rearward of the mounting hole 36, for receiving an end of the spring 28. The ends 40 and 44 of the elongated body 32 of the staging lock 22 are preferably tapered on the chassis side, or inward side, of the staging lock 22, such that the tapered ends 42 and 46 taper to a thickness which is thinner than the peripheral edges of the central portion 34. The peripheral edge 48 of the elongated body 32 is preferably chamfered to provide a smooth engaging surface which will not hang upon parts of mating slide members.

FIG. 3 is an exploded, perspective view of the staging lock 22, the rivet 26 and the spring 28 as viewed from an outward side, or cabinet side, of the staging lock 22. A relief space 50 is formed on a lower portion of the outward side of the staging lock 22, and defines a relief surface 52 which is recessed into the staging lock 22 and defines a relief edge 54. The relief space 50 provides clearance for receiving the bias spring 28. The bias spring 28 is preferably disposed between the relief surface 52 and the web portion of the intermediate member 16, enclosing the end portions 96 and 98 of the spring 28.

Referring to FIGS. 2 and 3, the staging lock 22 has an actuating portion 56 which comprises a follower tab 58 and a lock tab 66. The follower tab 58 has an arcuately-shaped follower surface 60 located on the lower end of the follower tab 58 for engaging the actuating cam 106 formed into the cabinet member 14. (See FIG. 4). The follower tab 58 has an upper surface 62 disposed on an opposite side of the follower tab 58 from the follower surface 60. The upper surface 62 is preferably co-planar and continuous with a surface 72 of the lock tab 66. When mounted to the intermediate member 16, the follower tab 58 extends through a window 64 formed into the web portion of the intermediate member 16 and engages the actuating cam 106 of the cabinet member 14 when the intermediate member is fully extended from within the chassis member 16. (See FIGS. 4 and 5). The lock tab 66 extends from a forward end of the staging lock 22 and towards the chassis member 18 for engaging the staging lock catch 114 formed into the web portion of the chassis member 18 (See FIG. 5). The lock tab 66 has a follower surface 68 which is formed such that it is preferably inclined to the horizontal, and a lock surface 70 defined on a rearward end of the lock tab 66. The upper surface 72 of the lock tab 66 is preferably flat, and co-planar with the surface 62 on the follower tab 58.

Still referring to FIGS. 2 and 3, the rivet 26 defines a mounting boss having a head 76 and a shank 78. The portion of the shank 78 adjacent the head 76 preferably defines a round bearing surface 80 which engages within the surface of the mounting hole 36 of the staging lock 22, for rotatably mounting the staging lock 22 to the intermediate member 16. The shank 78 further includes a rivet end 82 which is disposed opposite the bearing surface 80 from the head 76. The rivet end 82 is expanded to secure the rivet 26 to the intermediate member 16 with the staging lock 22 rotatably secured about the bearing surface 80. Locating tabs 84, preferably two, extend from an edge 86 of the bearing surface 80 along side a portion of the rivet end 82. The locating tabs 84 are provided for fixedly securing, or non-rotatably securing, the rivet 26 to the intermediate member 16. The rivet end 82 of the rivet 26 will extend through a mounting hole 88 in the web portion of the intermediate member 16, with the locating tabs 84 fitting within locating tab recesses 90, which preferably are adjacent to and continuous with the mounting hole 88 formed into the intermediate member 16.

The bias spring 28 has an arcuately shaped, elongated body 94 which is preferably formed of a spring wire. The body 94 of the spring 28 will fit within the relief space 50 adjacent the relief surface 52 on the cabinet side of the staging lock 22, enclosing the end portions of the spring 28. The end portions of the spring 28 are formed into an L-shaped configuration to define a mounting tab 96 and a mounting tab 98, each of the opposite end portions extending orthogonal to a central portion of the spring 28 and orthogonal to the longitudinal axis 30 when mounted to the intermediate member 16. The mounting tab 96 extends through the spring mounting hole 38 formed into the rearward end of the staging lock 22, and the mounting tab 98 extends through a spring mounting aperture 102 formed in the intermediate member 16. The mounting tab 98 is preferably formed of one of the terminal ends of the spring 28 in an L-shape, and the wire forming the spring 28 is doubled, with one portion of the spring 28 disposed adjacent to another portion. The mounting tab 96 is preferably L-shaped. A spring mounting tab 100 is formed into an edge of the web portion of the intermediate member 16, and is preferably formed for securing a central portion of the bias spring 28 to the intermediate member 16. In some embodiments, the spring may fit between an outward end portion of the tab 100 and the web portion of the intermediate member 16 in a press fit engagement, such that it snaps into the intermediate member 16. The web portion of the intermediate member 16 further includes the spring mounting aperture 102 for receiving the mounting tab 98 of the bias spring 28.

Figure 4:
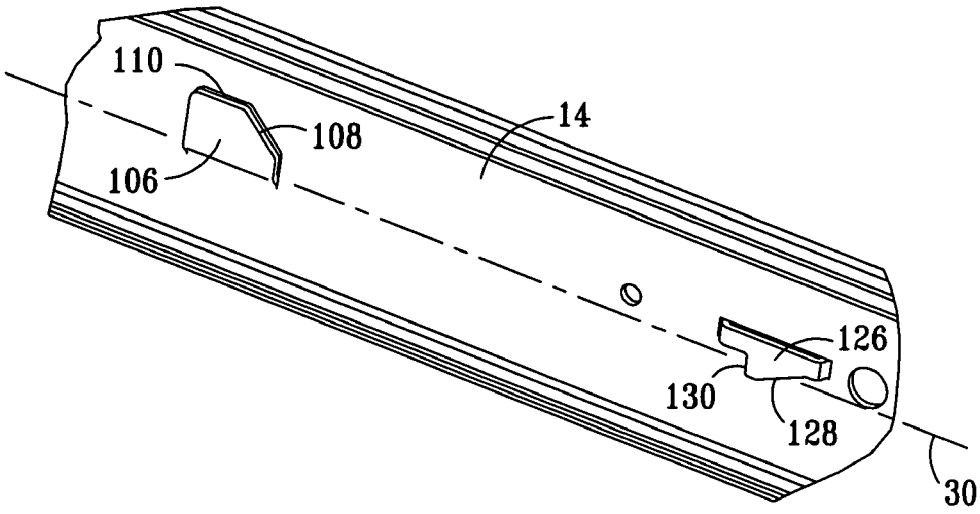

FIG. 4 is a partial, perspective view of an inward side of the cabinet member 14. The cabinet member 14 preferably includes an actuating cam 106 and a rear lock catch 126, which are preferably protuberant bosses formed by as embossments in the web portion of the cabinet member 14. In other embodiments, the actuating cam 106 and the lock catch 126 may be provided by separate members mounted to the cabinet member 14. The actuating cam 106 provides a protuberance which extends outward from the web portion of the cabinet member 14 towards the intermediate member 16 and the chassis member 18. The actuating cam 106 has a cam surface 108 for engaging the follower tab 58 of the staging lock 22 to move the staging lock 22 from a closed position (shown in FIG. 6), for locking the chassis member 18 from extending within the intermediate member 16, to an open position (shown in FIG. 7), in which the chassis member 18 is unlocked for extending from within the intermediate member 16. A retaining surface 110 is defined adjacent to the cam surface 108 on an upwardly disposed portion of the actuating cam 106. The rear lock catch 126 has a cam surface 128 and a stop 130 for engaging the lock tab 142 of the rear lock 24. The cam surface 128 for engages the lock tab 142 of the rear lock 24 for moving the rear lock from a first position (shown in FIG. 5) disposed for engaging the stop surface 130 when disposed adjacent to the stop 130, to a second position in which the lock tab 142 is disposed for release and for entering into engagement with the stop surface 130. The lock tab 142 of the rear lock engages the stop 130 to secure the rear lock 24 and the intermediate member 16 in fixed relation to the cabinet member 14, with the intermediate member 16 in an extended position relative to the cabinet member 14.

Figure 5:
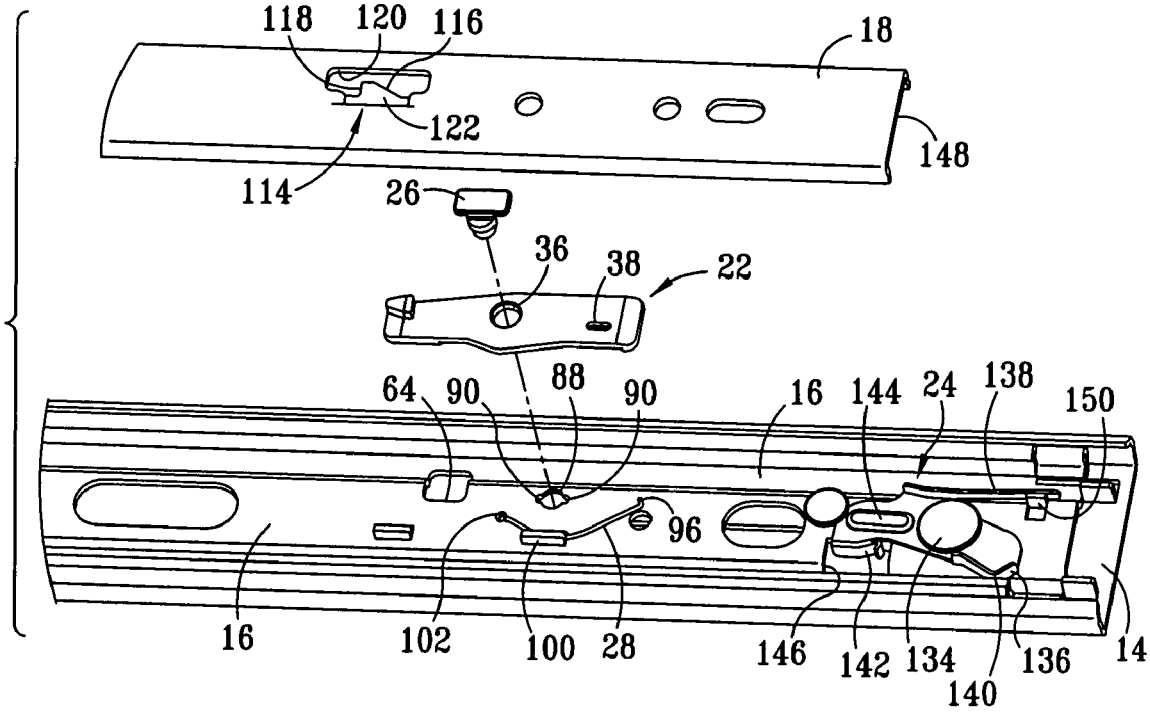

FIG. 5 is a partial, exploded view of the drawer slide 12 showing the staging lock 22 and the rear lock 24 mounted to the intermediate member 16, and a staging lock catch 114 of the chassis member 18. The staging lock catch 114 is preferably a protuberant boss formed as an embossment in the web portion of the chassis member 18. In other embodiments, the staging lock catch 114 may be provided as a separate member mounted to the chassis member 18. The staging lock catch 114 has a stop 118 and a cam surface 116. The cam surface 116 engages the lock tab 66 to urge the lock tab 66 into a position for engaging the stop 118. The stop 118 is preferably orthogonal to the longitudinal axis 30, and the cam surface 116 extends at an angle to the longitudinal axis 30. A window 120 is formed into the web portion of the chassis member 18 to provide a passage for the lock tab 66 to pass into the staging lock catch 114 for engaging the cam surface 116 and the stop 118. The staging lock catch 114 preferably has a surface 122 which is spaced apart from the surface of the web portion of the chassis member 18, such that the staging lock 114 is spaced apart from the web portion of the chassis member 18 in a direction towards the intermediate member 16 and the cabinet member 14.

The rear lock 24 is moveably mounted to the web portion of the intermediate member 16 by a mounting boss defined by rivet a 134, preferably in a rotatably mounted arrangement. The rear lock 24 includes a tab 136 and a cam follower edge 140 defined by the tab 136. The cam follower edge 140 of the rear lock tab 136 engages within the profile 148 of the chassis member 18 defined by the flange portions and web portion of the chassis member 18. The tab 136 engages within the profile 148 of the chassis member 18 to move, preferably rotate, the rear lock 24 from a first position, a lock position, to a second position, a release position. In the lock position, the rear lock 24 is aligned for engaging the cam surface 128 and moving alongside and then adjacent to the stop surface 130 for engaging the stop surface 130 of the rear lock catch 126. In the release position, the rear lock 24 is disposed in a position removed from being disposed adjacent the stop surface 130, such that the rear lock 24 will not engage either the stop surface 130 or the cam surface 128. The rear lock 24 preferably has an integral spring arm 138 which extends to engage between a pair of tabs 150 (one shown) formed as parallel lance protrusion into one side of the web portion of the intermediate member 16. A lock tab 142 extends through a window 146 formed into the web portion of the intermediate member 16 for engaging the rear lock catch 126 of the chassis member 14. When the intermediate member 16 is moving forward relative to the cabinet member 14, the lock tab 142 will engage the cam surface 128 and move adjacent the stop surface 160, and the spring arm 138 will then urge the lock tab 142 to a position for abutting the stop surface 130. The lock tab 142 abuts the stop surface 130 to prevent the intermediate member 16 from being retracted into the cabinet member 14, retaining the intermediate member 16 in an extended position. The intermediate member 16 will preferably remain in the extended position until the chassis member 18 is fully retracted within the intermediate member 16, such that the profile 148 of the chassis member 18 engages the cam follower edge 140 defined by the tab 136 to urge the lock tab 142 to move outward and aside of the stop surface 130 of the rear lock catch 126. The rear lock 24 is preferably stamped from sheet metal, with the tab 136 and the integral spring arm 130 and the lock tab 142 formed as an integral part from a single piece of metal. A strengthening rib 144 is formed in a central portion of the rear lock 24 by an embossment.

Figure 6:
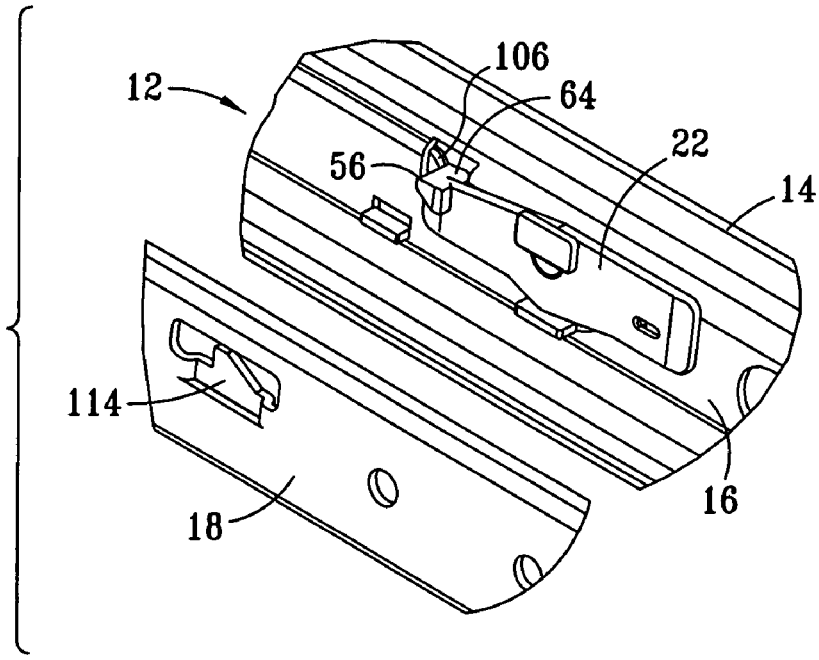

FIG. 6 is a partial, exploded view of the drawer slide 12, showing the chassis member 18 spaced apart from the intermediate member 16 and the staging lock 22. The staging lock 22 is shown disposed in a closed position, or locking position, just as the staging lock 22 is engaging the actuating cam 106 formed into the cabinet member 14. The actuating portion 56 of the staging lock 22 will engage the staging lock catch 114 to retain the chassis member 18 from extending from within the intermediate member 16, until the actuating portion 56 engages the actuating cam 106 as the chassis member 18 and the intermediate member 16 are moved together from within the cabinet member 14.

Figure 7:
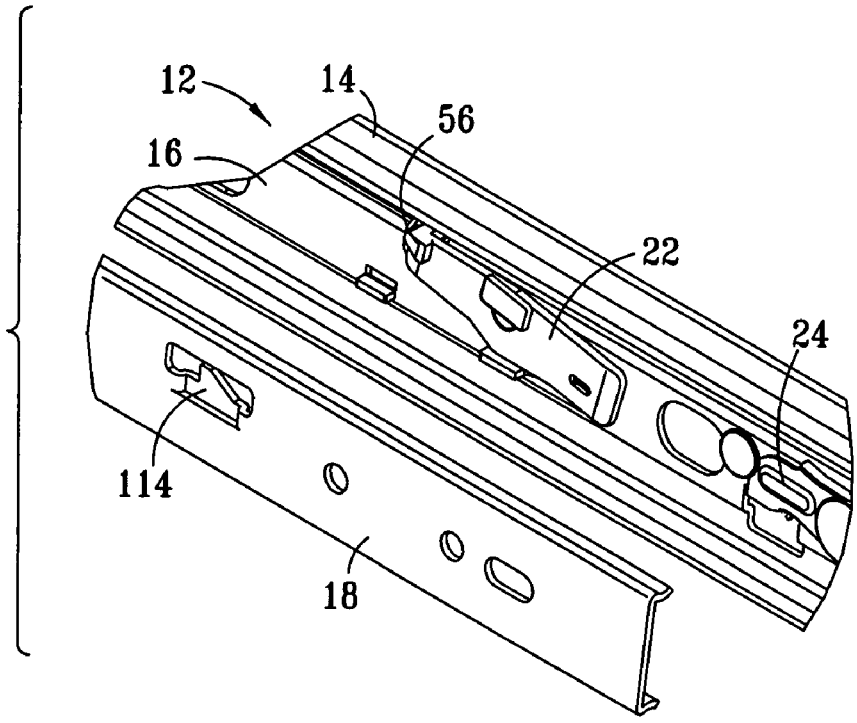

FIG. 7 is a partial, exploded perspective view of the drawer slide 12, showing the staging lock 22 after it has engaged the actuating cam 106 to move from a closed, or locking position, to an open position, or unlocked position, in which the actuating portion 56 on the forward end of the staging lock 22 is released from engaging the staging lock catch 114. The chassis member 18 is now free to slidably extend from within the intermediate member 16. Upon release of the staging lock 22, the rear lock 24 is configured for moving into a locked position, engaging the stop surface 130 of the rear lock catch 126 to retain the intermediate member 16 in a fully extended position, prevented from retracting into the cabinet member 14. Movement of the chassis member 18 back into the intermediate member 16 will engage the profile 148 of the chassis member 18 with the cam follower edge 140 defined by the tab 136 of the rear lock 24 to move the rear lock tab 142 from engaging the rear lock catch 126, and allowing the intermediate member 16 to move from the extended position to retract into the cabinet member 14.

A staging lock and a rear lock are provided which are moveably mounted to an intermediate member in spaced apart relation. The staging lock engages the chassis member and prevents the chassis member from extending from within the intermediate member until the intermediate member is fully extended from within the cabinet member. An actuating cam and a rear lock catch are provided by embossments formed into the web portion of the cabinet member. The actuating cam and the rear lock catch are configured such that during movement of the chassis member and the intermediate member from within the cabinet member, the actuating cam will move the staging lock from engaging the chassis member and the rear lock catch will be engaged by the rear lock when the intermediate member is in a fully extended position relative to the cabinet member. As the chassis member is moved from being extended to being fully retracted within the intermediated member, the staging lock will engage the chassis member and the rear lock will release the cabinet member such that the chassis member and the intermediate member are retracted together into the cabinet member, in fixed relative relation. Preferably, the staging lock catch, the actuating cam and the rear lock catch are provided by embossments stamped into web portions of respective ones of the chassis member and the cabinet member.

Although the preferred embodiment has been described in detail, it should be understood that various changes, substitutions and alterations can be made therein without departing from the spirit and scope of the invention as defined by the appended claims.

What is claimed is:

1. A drawer slide comprising:

a first slide member;

a second slide member which is slidably extensible from within the first slide member, from a rearward position to a forward position;

a third slide member which is slidably extensible from within the second slide member from a retracted position to an extended position relative to the second slide member;

a staging lock having a forward end, a rearward end, a central portion, a follower tab extending from said forward end toward the first slide member, and a lock tab extending from said forward end toward the third slide member; the staging lock further comprising a spring relief space formed into a side of said staging lock to define a relief surface which is spaced apart from said side by a relief edge;

a mounting boss extending between said central portion of said staging lock and a web portion of the second slide member, wherein said mounting boss rotatably secures said staging lock to the web portion of the second slide member, such that said staging lock is moveable between an open position and a closed position;

a bias spring having opposite end portions, one of said end portions engaging the second slide member and an other of said end portions secured to said staging lock, wherein said opposite end portions of said bias spring are spaced apart from said mounting boss, on opposite sides of said mounting boss; said spring relief space receiving said bias spring to enclose at least said opposite end portions of said bias spring between said relief surface and the web portion of the second slide member;

said third slide member including a staging lock catch for engaging said lock tab to secure said third slide member in fixed relation to said second slide member as said third slide member is moved from the extended position into the retracted position; and said first slide member including an actuating cam which engages said follower tab and rotates said staging lock from said closed position to said open position, such that said lock tab is moved away from engaging said staging lock catch and the third slide member is released for moving from the retracted position toward the extended position.

2. The drawer slide according to claim 1, wherein the staging lock catch is formed as an embossment formed into a web portion of the third slide member, and said actuating cam is formed as an embossment on the first slide member.

3. The drawer slide according to claim 1, wherein said bias spring is formed of a length of wire having terminal ends which are formed to define said opposite end portions.

4. The drawer slide according to claim 1, further comprising a window formed into the web portion of the second slide member for passing one of said follower tab from an inner side to an outer side of the web portion of the second slide member.

5. The drawer slide according to claim 1, further comprising:

said mounting boss having a shank and a head, said shank having a bearing portion disposed adjacent said head, an end and locating tabs, said locating tabs extending from an edge portion of said bearing portion and along said end of said shank;

a mounting hole formed in said web portion of the second slide member, said mounting hole having locating tab recesses for receiving said locating tabs of said shank of said mounting boss to non-rotatably secure said mounting boss to the second slide member; and said central portion of said staging lock having a mounting hole extending therein which slidably engages said bearing portion of said mounting boss to rotatably secure said staging lock to said second slide member.

6. The drawer slide according to claim 1, further comprising a rear lock rotatably mounted to the second slide member for moving between a lock position and a release position, and a spring which biases said rear lock into said lock position, said rear lock including a lock tab extending from said rear lock for engaging a rear lock catch of the first slide member to retain said second slide member in the forward position, and a follower portion which is engaged by the third slide member when the third slide member is disposed in the retracted position, wherein the third slide member engaging said follower portion moves said rear lock to said release position, which releases said lock tab from engaging said rear lock catch to release the second slide member to move from the forward position to the rearward position.

7. The drawer slide according to claim 6, wherein said staging lock, said staging actuating cam, said staging lock catch, said rear lock and said rear lock catch are configured in relative relation such that said staging lock will move to the open position as said rear lock engages said rear lock catch as the second and third slide members are moved outward from the first slide member, and said rear lock will move to said release position as said staging lock engages said staging lock catch as the third slide member is moved into the second slide member.

8. A drawer slide comprising:

a first slide member;

a second slide member which is slidably extensible from within the first slide member, from a rearward position to a forward position;

a third slide member which is slidably extensible from within the second slide member from a retracted position to an extended position relative to the second slide member;

a staging lock having a forward end, a rearward end, a central portion extending between said forward end and said rearward end, a follower tab extending from said forward end toward the first slide member, a lock tab extending from said forward end toward the third slide member, and side which faces toward a web portion of the second slide member;

a mounting boss extending between said central portion of said staging lock and the web portion of the second slide member, wherein said mounting boss rotatably secures said staging lock to the web portion of the second slide member such that said staging lock is moveable between an open position and a closed position;

a bias spring having opposite end portions, one of said end portions secured to the web portion of the second slide member and an other of said end portions secured to said central portion of an elongated body of said staging lock;

a spring relief space formed in said side of said staging lock, defining a relief surface which is spaced apart from said side by a relief edge, said spring relief space configured for receiving said bias spring to enclose at least said opposite end portions of said bias spring between said relief surface and the web portion of the second slide member;

said third slide member including a staging lock catch having a staging lock cam surface which faces rearward and a stop disposed forward of said staging lock cam surface, wherein said stop and said staging lock cam surface are configured such that said lock tab engages said staging lock cam surface and rotates said staging lock to move said lock tab adjacent to said stop as said third slide member is moved from the extended position into the retracted position;

said first slide member including an actuating cam having a cam surface which faces rearward and a retaining surface disposed forward of said cam surface, wherein said cam surface and said retaining surface are configured such that said follower tab engages said cam surface and said staging lock is rotated to move said follower tab adjacent said retaining surface as said second slide member is moved from said rearward position into said forward position; and wherein said follower tab engaging said actuating cam and rotating said staging lock adjacent said retaining surface moves said staging lock into said open position, in which said lock tab is moved away from being disposed adjacent said stop and the third slide member is released for moving from the retracted position toward the extended position.

9. The drawer slide according to claim 8, wherein the staging lock catch is formed as an embossment formed into a web portion of the third slide member, and said actuating cam surface is formed as an embossment on the first slide member.

10. The drawer slide according to claim 8, wherein said bias spring is formed of a length of wire having terminal ends which are formed to define said opposite end portions.

11. The drawer slide according to claim 8, further comprising a window formed into the web portion of the second slide for passing one of said follower tab from an inner side to an outer side of the web portion of the second slide member.

12. The drawer slide according to claim 8, wherein said opposite end portions of said bias spring are spaced apart from said mounting boss, on opposite sides of said mounting boss.

13. The drawer slide according to claim 8, further comprising:

said mounting boss having a shank and a head, said shank having a bearing portion disposed adjacent said head, an end and locating tabs, said locating tabs extending from an edge portion of said bearing portion and along said end of said shank;

a mounting hole formed in the web portion of the second slide member, said mounting hole having locating tab recesses for receiving said locating tabs of said shank of said mounting boss to non-rotatably secure said mounting boss to the second slide member; and said central portion of said staging lock having a mounting hole extending therein which slidably engages said bearing portion of said mounting boss to rotatably secure said staging lock to said second slide member.

14. The drawer slide according to claim 8, further comprising a rear lock rotatably mounted to the second slide member for moving between a lock position and a release position, and a spring which biases said rear lock into said lock position, said rear lock including a lock tab extending from said rear lock for engaging a rear lock catch of the first slide member to retain the second slide member in said forward position, and a follower portion which is engaged by the third slide member when the third slide member is disposed in the retracted position, wherein the third slide member engaging said follower portion moves said rear lock to said release position, which releases said lock tab from engaging said rear lock catch to release the second slide member to move from the forward position to the rearward position.

15. The drawer slide according to claim 14, wherein said staging lock, said actuating cam, said staging lock catch, said rear lock and said rear lock catch are configured in relative relation such that said staging lock will move to the open position as said rear lock engages said rear lock catch as the second and third slide members are moved outward from the first slide member, and said rear lock will move to said release position as said staging lock engages said staging lock catch as the third slide member is moved into the second slide member.

16. In a drawer slide having a first slide member, a second slide member slidably extensible from within the first slide member from a rearward position to a forward position, and a third slide member slidably extensible from within the second slide member from a retracted position to an extended position relative to the second slide member, the improvement comprising:

a staging lock having an elongated body which includes a forward end, a rearward end, a central portion extending between said forward end and said rearward end, a follower tab extending from said forward end of said elongated body toward the first slide member, a lock tab extending from said forward end of said elongated body toward the third slide member, an inward side facing toward the third slide member, an outward side facing toward the first slide member, wherein said inward side and said outward side define a peripheral edge of said elongated body, and said forward end and said rearward end are tapered such that said peripheral edge is thinner adjacent said forward and rearward ends than adjacent said central portion of said elongated body;

a mounting boss having a rectangular-shaped head and a shank, said shank having a bearing portion disposed adjacent said head, an end and locating tabs, said locating tabs extending from an edge portion of said bearing surface and along said end of said shank;

a mounting hole and a window formed in a web portion of the second slide member, said mounting hole having locating tab recesses for receiving said locating tabs of said shank of said mounting boss to non-rotatably secure said mounting boss to the second slide member, and said window being disposed for passing one of said follower tabs and said lock tab from one side of the web portion of the second slide member to an other side of the web portion;

said central portion of said elongated body having a mounting hole extending therein which slidably engages said bearing portion of said mounting boss to rotatably secure said staging lock to said second slide member, such that said staging lock is angularly moveable between an open position and a closed position;

a bias spring formed of a length of wire having opposite end portions, one of said end portions disposed in an aperture formed in the web portion of the second slide member and an other of said end portions disposed in a hole formed in said central portion of said elongated body of said staging lock, wherein said opposite end portions of said bias spring are spaced apart from said mounting boss, on opposite sides of said mounting boss;

a spring relief space formed in one of said inner and outer sides of said elongated body, defining a relief surface which is spaced apart from said one of said inner and outer sides by a relief edge, said spring relief space configured for receiving said bias spring to enclose at least said opposite end portions of said bias spring between said relief surface and the web portion of the second slide member;

said third slide member including a staging lock catch having a staging lock cam surface which faces rearward and a stop disposed forward of said staging lock cam surface, wherein said stop and said staging lock cam surface are configured such that said lock tab engages said staging lock cam surface and rotates said staging lock to move said lock tab adjacent to said stop as said third slide member is moved from the extended position into the retracted position;

said first slide member including an actuating cam having a cam surface which faces rearward and a retaining surface disposed forward of said cam surface, wherein said cam surface and said retaining surface are configured such that said follower tab engages said cam surface and said staging lock is rotated to move said follower tab adjacent said retaining surface as said second slide member is moved from said rearward position into said forward position; and wherein said follower tab engaging said actuating cam and rotating said staging lock adjacent said retaining surface moves said staging lock into said open position, in which said lock tab is moved away from being disposed adjacent said stop surface and the third slide member is released for moving from the retracted position toward the extended position.

17. The drawer slide according to claim 16, further comprising a rear lock rotatably mounted to said second slide member for moving between a lock position and a release position, said rear lock having a spring means for biasing said rear lock into said lock position, a lock tab extending through a second window in the second slide member for engaging a rear lock catch of the first slide member to retain the second slide member in said forward position, and a follower portion which is engaged by a profile of the third slide member when the third slide member is disposed in the retracted position, wherein the profile of the third slide member engaging said follower portion moves said rear lock to said release position, which releases said lock tab from engaging said rear lock catch to release the second slide member to move from the forward position to the rearward position.

18. The drawer slide according to claim 17, wherein said staging lock, said actuating cam, said staging lock catch, said rear lock and said rear lock catch are configured in relative relation such that said staging lock will move to the open position as said rear lock engages said rear lock catch as the second and third slide members are moved outward from the first slide member, and said rear lock will move to said release position as said staging lock engages said staging lock catch as the third slide member is moved into the second slide member.

19. The drawer slide according to claim 18, wherein said rear lock is rotatably mounted to the web portion of the second slide member by a second mounting boss, and said spring means comprises a spring arm integrally formed as a single member with said rear lock, wherein said rear lock and said spring means are formed of a single piece of metal, and wherein an end portion of said spring arm is retained in a fixed position relative to the second slide member by at least one lance portion formed to extend from the second slide member.

* * * * *